US011771198B2

(12) United States Patent
Bickford

(10) Patent No.: US 11,771,198 B2
(45) Date of Patent: Oct. 3, 2023

(54) PULVERIZER FOR COSMETIC FORMULATIONS

(71) Applicant: L'OREAL, Paris (FR)

(72) Inventor: William Robert Bickford, Scotch Plains, NJ (US)

(73) Assignee: L'Oreal, Paris (FR)

( * ) Notice: Subject to any disclaimer, the term of this patent is extended or adjusted under 35 U.S.C. 154(b) by 185 days.

(21) Appl. No.: 17/364,190

(22) Filed: Jun. 30, 2021

(65) Prior Publication Data

US 2023/0000231 A1 Jan. 5, 2023

(51) Int. Cl.
*B02C 19/08* (2006.01)
*A45D 33/02* (2006.01)

(52) U.S. Cl.
CPC ..... *A45D 33/02* (2013.01); *B02C 19/08* (2013.01)

(58) Field of Classification Search
CPC .. A47J 42/32; A47J 42/34; A47J 42/24; A47J 42/14
USPC ..... 241/169.2
See application file for complete search history.

(56) References Cited

U.S. PATENT DOCUMENTS 73,743 A * 1/1868 Monron ..... A47J 19/04 241/169.2
178,228 A * 6/1876 Brown ..... A47J 19/04 241/169.2
357,693 A * 2/1887 Gourlie ..... A47J 19/04 D7/682
370,861 A * 10/1887 Beum ..... A47J 42/34 D7/682
472,515 A * 4/1892 Apple ..... A47J 19/04 D7/682
915,577 A * 3/1909 Farmer ..... A47J 19/04 D7/682
1,034,908 A * 8/1912 Grant ..... A47J 43/1075 416/65
1,077,832 A * 11/1913 Holt ..... A47J 43/105 D7/690
1,084,102 A * 1/1914 Olson ..... A47J 19/04 241/169.2
1,170,358 A * 2/1916 Sweeting ..... B02C 19/18 241/301
1,661,374 A 3/1928 Lacey
(Continued)

FOREIGN PATENT DOCUMENTS

CN 204972269 U 1/2016
WO 2012/074329 A2 6/2012

OTHER PUBLICATIONS

Rapport De Recherche Préliminaire / Opinion Écrite Sur La Brevetabilité De L'Invention mailed Jun. 7, 2022, issued in corresponding French Application No. 2111142, filed Oct. 20, 2021, 6 pages.

*Primary Examiner* — Faye Francis
(74) *Attorney, Agent, or Firm* — Christensen O'Connor Johnson Kindness PLLC

(57) ABSTRACT

A pulverizing device that include a pulverizing or grinding component for generating powder from the solid product. The pulverizing or grinding component also constrains and/or supports the solid product. The pulverizing or grinding component moves somewhat linearly with respect to the solid product in order to pulverize the solid product. The pulverizing or grinding component includes a spiral spring or a helical spring.

11 Claims, 5 Drawing Sheets

(56) References Cited

U.S. PATENT DOCUMENTS

| | | | | | |
|---|---|---|---|---|---|
| 3,107,711 | A | * | 10/1963 | Azmus | A22C 7/00 241/301 |
| 4,341,356 | A | * | 7/1982 | Hiott | B02C 19/08 241/199.9 |
| 4,366,930 | A | | 1/1983 | Trombetti, Jr. | |
| 4,714,205 | A | * | 12/1987 | Steinko | A47J 19/06 241/95 |
| 4,715,545 | A | * | 12/1987 | Hanifl | G01N 1/286 600/562 |
| 4,967,971 | A | * | 11/1990 | Smith | A61J 7/0007 241/DIG. 27 |
| 5,033,375 | A | | 7/1991 | Reeves | |
| 5,376,072 | A | * | 12/1994 | Klearman | A61J 7/0007 604/82 |
| 5,533,683 | A | * | 7/1996 | Fay | B02C 2/10 241/199.12 |
| 6,622,949 | B1 | * | 9/2003 | Baswick | B02C 19/08 241/DIG. 27 |
| 7,427,041 | B2 | * | 9/2008 | Hall | A61J 7/0007 241/168 |
| D585,708 | S | * | 2/2009 | Gransbury | D7/682 |
| D647,366 | S | * | 10/2011 | Enghard | D7/412 |
| D664,392 | S | * | 7/2012 | Enghard | D7/412 |
| D736,559 | S | * | 8/2015 | Enghard | D7/397 |
| D828,079 | S | * | 9/2018 | Winn | B01F 35/32021 D7/397 |
| 10,588,463 | B2 | * | 3/2020 | Enghard | B01F 33/253 |
| 2018/0271751 | A1 | * | 9/2018 | Torres | B02C 19/08 |
| 2022/0110485 | A1 | * | 4/2022 | Dos Santos | A47J 42/24 |

* cited by examiner

PULVERIZER FOR COSMETIC FORMULATIONS

TECHNICAL FIELD

Embodiments of the present disclosure relate to an apparatus for pulverizing friable materials. Some embodiments of the present disclosure relate to an apparatus for pulverizing friable cosmetic formulations into, for example, powder form. Embodiments of the present disclosure also relate to methods for pulverizing these materials, for example, into powder form.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with an aspect of the present disclosure, an apparatus is provided which comprises a housing having a cavity and a dispensing outlet, a plunger movably supported by the housing, a first end of the plunger being positioned exteriorly of the housing and a second end of the plunger being positioned inside the cavity, and an extension spring disposed in the housing, the extension spring arranged and configured to receive or support a friable material adjacent the second end of the plunger. In some embodiments, continuous movement of the plunger against the friable material causes relative movement between the friable material and the coil spring, wherein during such relative movement the coil spring applies a shearing force to the friable material for pulverizing the friable material into powder to be dispensed from the dispensing outlet.

In some embodiments, the spring is a coil spring.

In some embodiments, the coil spring is a flat coil spring.

In some embodiments, the coil spring has a conical shape. The coil spring is inverted so as to have a first end with a first diameter adjacent the plunger, wherein the coil spring adapted to receive the friable material from the first end.

In some embodiments, the plunger movably supported by the housing for linear movement of the plunger.

In accordance with another aspect of the present disclosure, a pulverizing apparatus is provided. In an embodiment, the pulverizing apparatus includes a housing having a cavity and a dispensing outlet, a cosmetic product disposed in the housing, a plunger movably supported by the housing between a first, non-pulverizing position and a second, pulverizing position, a first end of the plunger being positioned exteriorly of the housing and a second end of the plunger being positioned inside the cavity and adjacent the cosmetic product, and a coil spring disposed in the housing, the coil spring arranged and configured to support the cosmetic product adjacent the second end of the plunger, wherein movement of the plunger from the first position to the second position causes the coil spring to apply a shearing force against the cosmetic product to pulverize the cosmetic product into powder to be dispensed from the dispensing outlet.

In some embodiments, the coil spring is a flat coil spring.

In some embodiments, the coil spring has a generally conical shape, the conical coil spring arranged in the cavity of the housing such that the smaller end of the conical coil spring is facing the outlet.

In some embodiments, the cosmetic product moves generally linearly with respect to the coil spring via movement of the plunger.

In some embodiments, the housing includes a linear bearing surface for movably supporting the plunger and guiding the plunger as the plunger moves linearly from the first position to the second position.

In some embodiments, the coil spring tapers from a first end having a first diameter to a second end having a second, smaller diameter, wherein the first end of the coil spring is positioned adjacent the second end of the plunger and is sized to receive the cosmetic product therein.

DESCRIPTION OF THE DRAWINGS

The foregoing aspects and many of the attendant advantages of disclosed subject matter will become more readily appreciated as the same become better understood by reference to the following detailed description, when taken in conjunction with the accompanying drawings, wherein.

DETAILED DESCRIPTION

The following discussion provides examples of devices suitable for use with cosmetics, and more particularly, to devices that pulverize, crush, grind or otherwise break up cosmetic formulations into powder, for example. In some examples, the cosmetic formulations are pulverized from a product having a solid, pressed, lyophilized or sintered form into a powder form. In some examples, the solid product in its manufactured form has a spherical shape.

In some embodiments, the cosmetic formulation to be pulverized may include but is not limited to various products for hair (e.g., coloration, cleansing, treatment, etc.), for skin (e.g., cleansing, anti-acne, photo-protection, makeup removal, etc.), for color cosmetics (e.g., foundations, concealers, cake mascara, tints, etc.) While the following examples describe the solid product as a cosmetic formulation, it will be appreciated that the solid product can be any friable material not limited to the cosmetics field.

As will be described in more detail below, examples of the pulverizing device include a pulverizing or grinding component for generating powder from the solid product. In some embodiments, the pulverizing or grinding component also constrains and/or supports the solid product. In some embodiments, the pulverizing or grinding component moves somewhat linearly with respect to the solid product in order to pulverize the solid product. In some embodiments, the pulverizing or grinding component includes a spiral spring or a helical spring.

Figure 1:
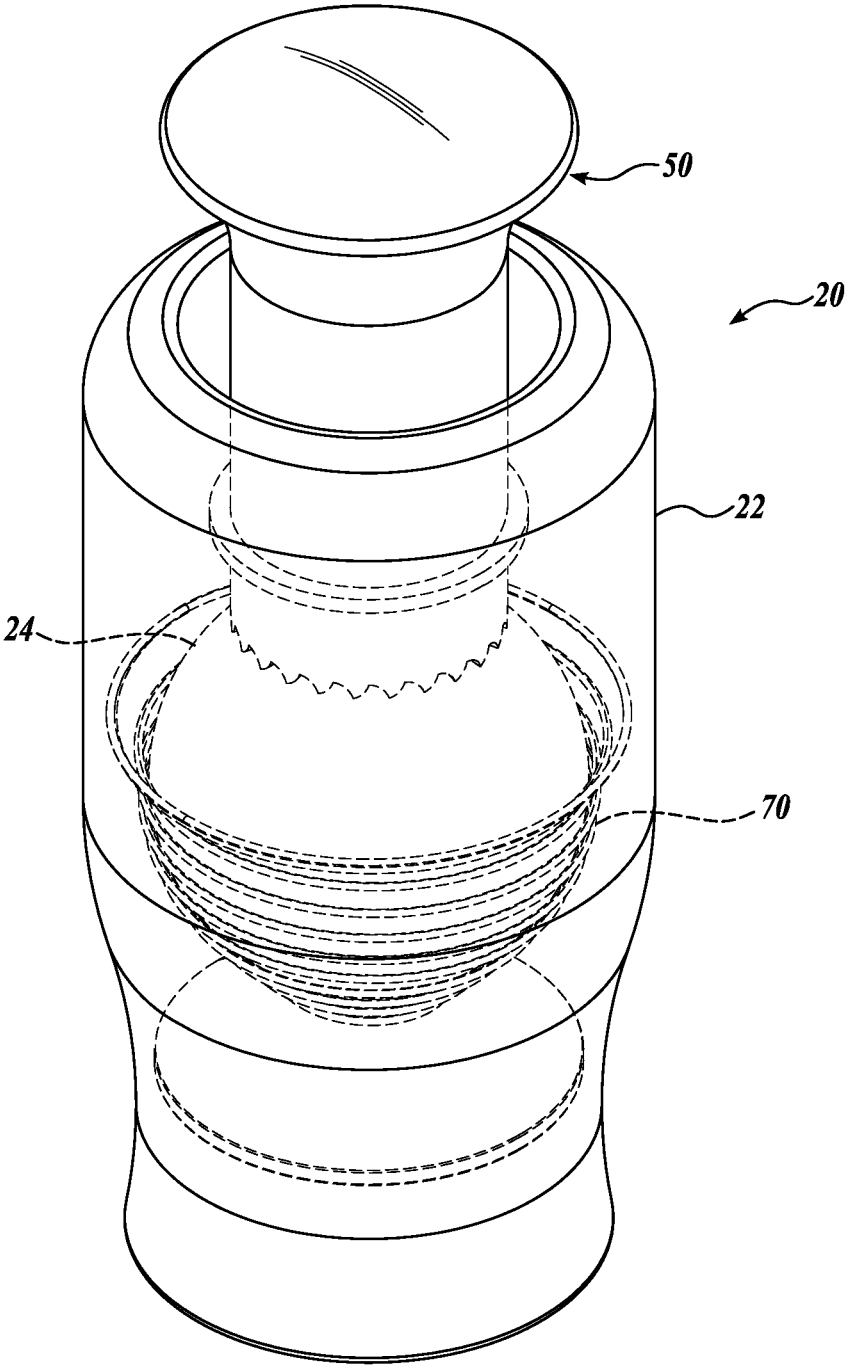
FIG. 1 is an isometric view of an example embodiment of a pulverizing device formed in accordance with principles of the present disclosure.
Figure 2:
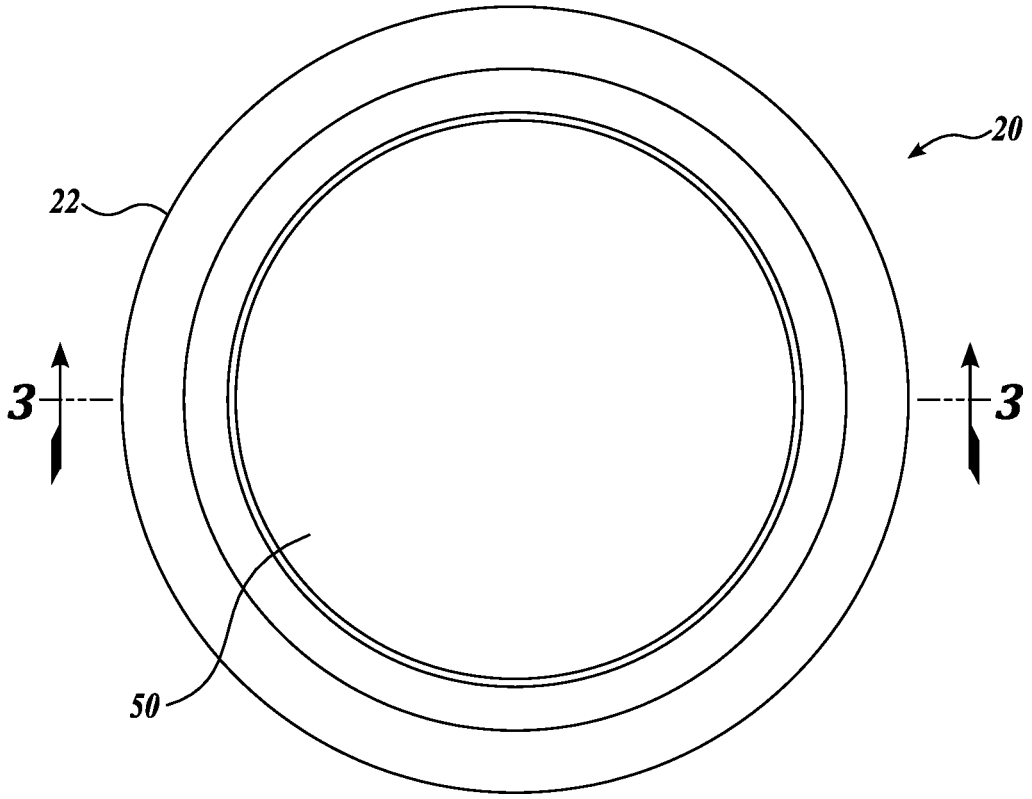
FIG. 2 is a top view of the pulverizing device of FIG. 1.

Turning now to FIGS. 1 and 2, an example of a pulverizing device, generally designated 20, according to an embodiment of the present disclosure is shown. As will be described in more detail below, the device 20 is suitable for pulverizing, grinding or otherwise breaking up friable material. In some embodiments, the friable material is a cosmetic formulation having a solid, pressed, lyophilized or sintered form. The friable material, also referred to herein as the solid product or the product, may be spherical in shape or have other convenient or suitable shapes.

As shown in FIGS. 1 and 2, the pulverizing device 20 includes a housing 22 for enclosing a friable material or solid product 24, a plunger 50, and a pulverizing or grinding component 70. In use, suitable movement of the plunger 50 forces the solid product 24 into the pulverizing component 70. With relative movement between the solid product 24 and the pulverizing component 70, the pulverizing device 20 is capable of pulverizing, grinding or otherwise breaking up the solid product 24 housed in the housing 22 into, for example, powder form. The pulverizing device 20 then dispenses the powder into the user's hand, a container or other surface, etc., for subsequent use (e.g., consumption, mixing, etc.).

Figure 3:
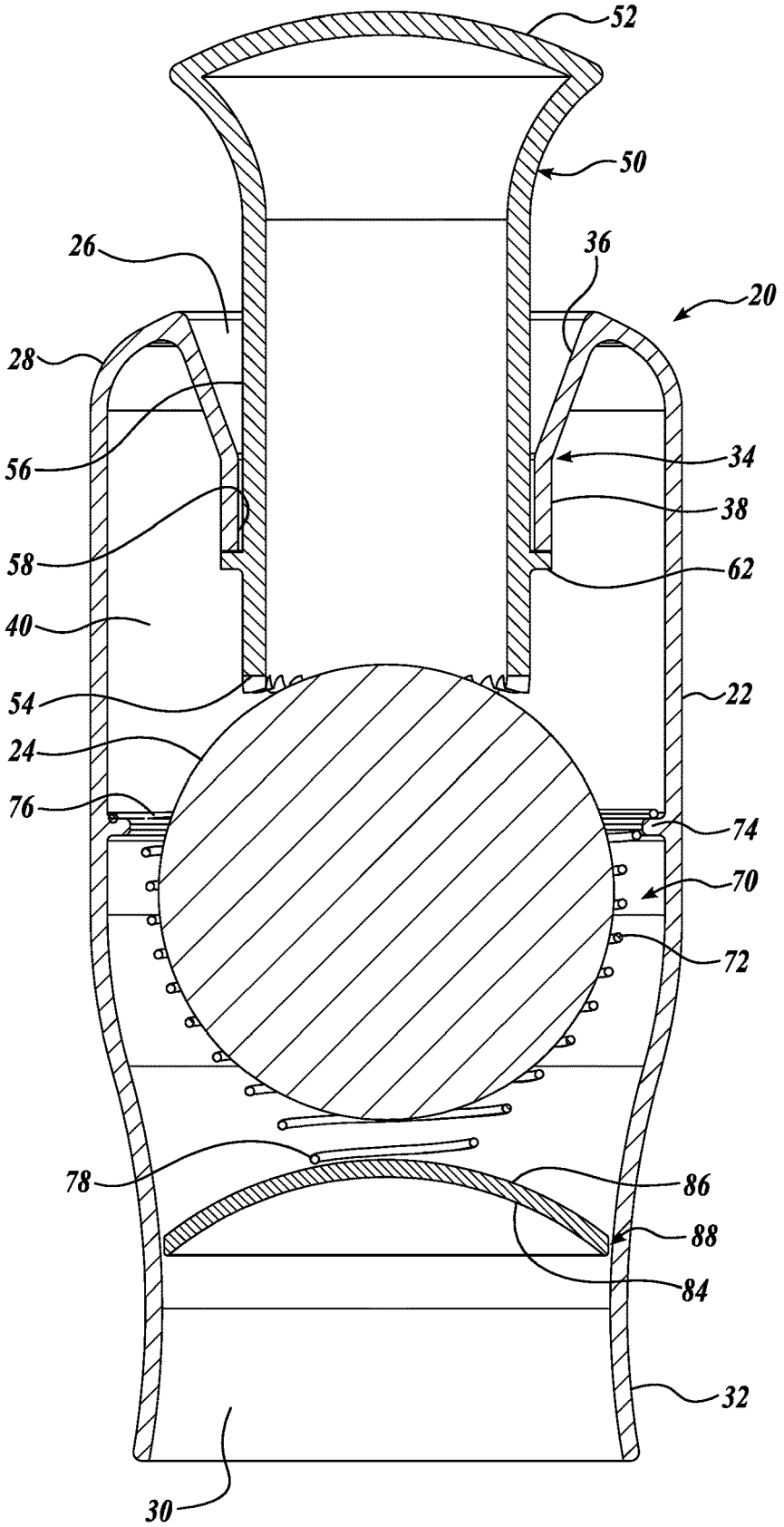
FIG. 3 is a longitudinal cross section of the pulverizing device of FIG. 1 taken along lines 2-2 in FIG. 2, the plunger of which being in a non-pulverizing position.
Figure 4:
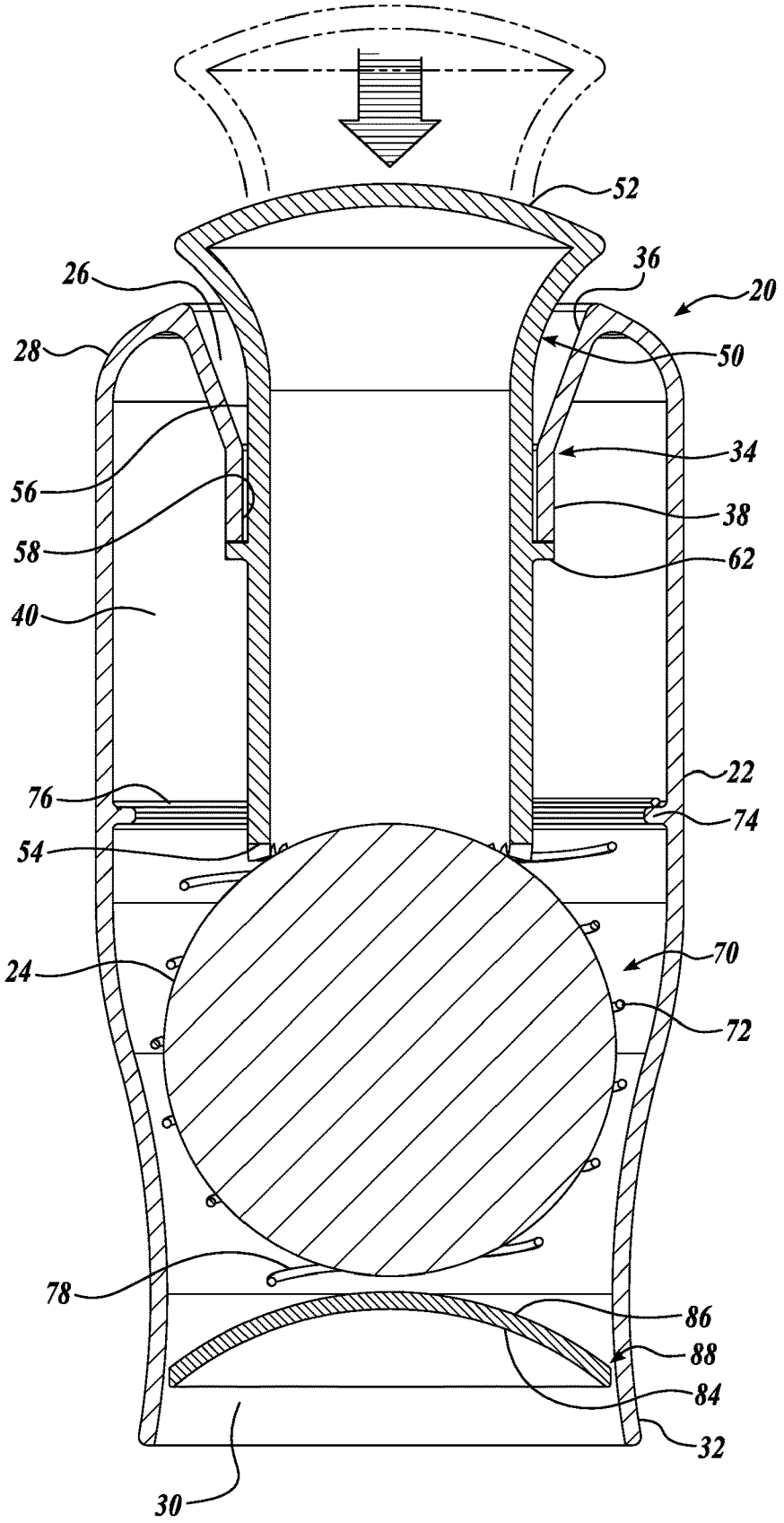
FIG. 4 is a longitudinal cross section of the pulverizing device of FIG. 3, with the plunger moved to a pulverizing position.

The components of the pulverizing device 20 will now be described in more detail referencing FIGS. 3 and 4. FIGS. 3 and 4 are longitudinal cross-sectional views of the device 20 shown in FIG. 1 taken along the lines 2-2 in FIG. 2. As shown in FIGS. 3 and 4, the housing 22 defines a first opening 26 at one end 28 and a second opening 30 at an opposite, second end 32. In the embodiment shown, the opening 26 is formed by an inner wall 34 comprised of a somewhat frustoconical upper section 36 and a cylindrical lower section 38. In some embodiments, the cylindrical lower section 38 of housing 22 is coincident with the longitudinal axis of the housing 22. From the cylindrical lower section 38, the first opening 26 communicates with a cavity 40 sized and configured for housing the solid product 24. At the second end 32 of the housing 22, the second opening 30 forms an outlet for dispensing the solid product 24 after at least some of the solid product has been broken into, for example, powder form.

Still referring to FIGS. 3 and 4, the plunger 50 extends exteriorly of the housing 22 through the first opening 26. At the end of the plunger 50 extending exteriorly of the housing 22 there is provided a handle 52. At the opposite end of the plunger 50, which extends interiorly of the housing 22 and into the cavity 40, there is provided a solid product contact surface 54. In the embodiment shown, the plunder 50 includes a cylindrical (e.g., tube, etc.) section 56 that extends from an area adjacent the handle 52 to the contact surface 54.

The cylindrical section 56 of the plunger 50 is sized and configured to be slidably received through the cylindrical lower section 38. The cylindrical lower section 38 defines a bearing surface 58 against which the plunger 50 (e.g., the cylindrical lower section) is slideably supported is a guiding manner. In other words, when the handle 52 is pushed/pulled inwardly/outwardly, movement of the plunger 50 is guided by the bearing surface 58. While complimentary cylindrical shapes are shown, other cross-sectional shapes may be practiced with embodiments of the present disclosure.

In some embodiments, the plunger 50 may include an external flange, one or more tabs, or other movement interfering means, generally designated 62, provided at a position along the lower cylindrical section 38. The movement interfering means 62 defines a stop against the interior end of the inner wall 34 so as to limit the outwardly (e.g., pulling) movement of the plunger 50, and in some embodiments, prohibits removal of the plunger 50 through the first opening 26. Similarly, the handle 52 in some embodiments is sized and configured so that the plunger 50 is prohibited from passing through the first opening 26 when moved in the direction of the cavity 40.

Still referring to FIGS. 3 and 4, the pulverizing component 70 is positioned within the cavity 40 of the housing 22. The pulverizing component 70 is configured to pulverize the solid product 24 as the plunger 50 is pushed or otherwise advanced inwardly against the solid product. In the embodiment shown, movement of the plunger 50 in a linear manner causes the pulverizing component 70 to pulverize the solid product 24 as the plunger 50 is pushed or otherwise advanced inwardly against the solid product. In the embodiment shown, the pulverizing component 70 includes an extension spring (shown as a coil spring) having a plurality of coils or loops. The extension spring is configured and arranged for contacting the solid product when the plunger 50 is pushed inwardly into the cavity 40. In some embodiments, the pulverizing component 60 may also be configured for receiving the solid product 24 at least partially therein.

In the embodiment shown, the pulverizing component 70 includes a coil spring 72 mounted within the cavity 40. For example, in the embodiment shown, one end (the plunger facing end) of the coil spring 72 is retained by an internally formed flange 74 that extends around the inner perimeter of the housing 22, or sections thereof. In some embodiments, at least the first coil or loop of the coil spring 72 is retained by the plunger facing surface of the flange 74.

Figure 5:
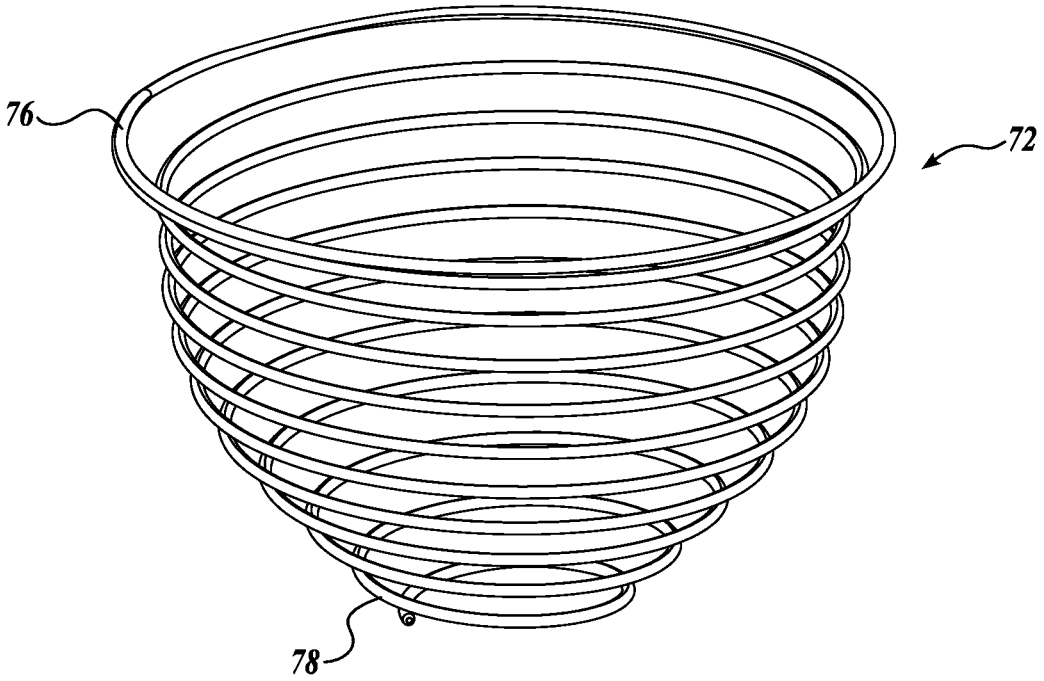
FIG. 5 is a perspective view one example of a coil spring that may be practiced with the pulverizing device of FIG. 1.

In some embodiments, the coil spring 72 is a conical or domed extension spring, as shown in FIG. 5. For example, the coil spring 72 may include one end 76 with a larger diameter and a second end 78 with a smaller diameter, wherein the coil spring 72 tapers (e.g., the coils get successively smaller in diameter) from the first, larger diameter end 76 to the second, smaller diameter end 78. In the embodiment of FIGS. 3 and 4, the coil spring 72 has an inverted orientation when assembled such that the first, larger diameter end 76 is retained by the flange 74 of the housing 22 and the second, smaller diameter end 78 is facing the second opening 30 of the housing 22. In other embodiments, the coil spring may have a cylindrical or other suitable shape.

Figure 6:
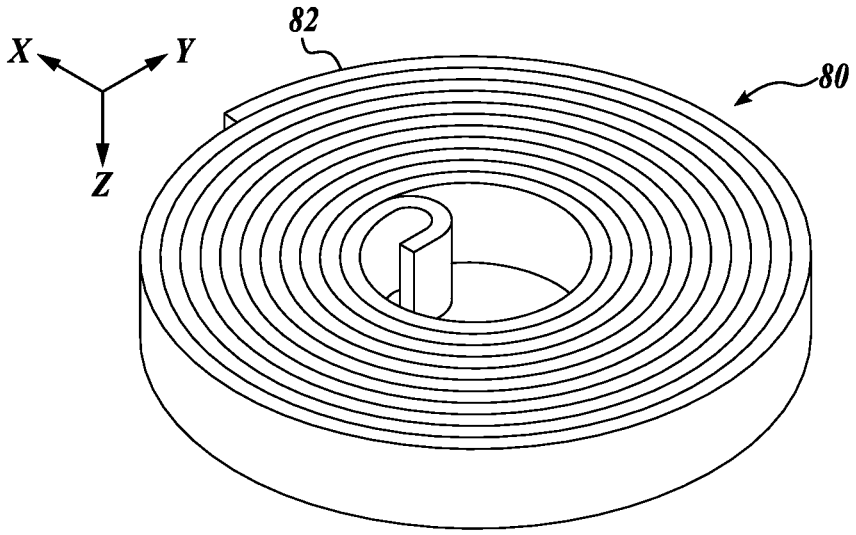
FIG. 6 is a perspective view one example of a spiral spring, also known as a flat coil spring, that may be practiced with the pulverizing device of FIG. 1.

Alternatively, as shown in FIG. 6, the extension spring can be a spiral spring 80 (i.e., a spring that is formed as a spiral in a two-dimensional (XY) plane) of the type typically used in torsion, sometimes referred to as a flat coil spring. In this embodiment, the spiral spring 80 is configured so that it can be extended in the Z direction when a force is applied in the Z direction thereto, and will revert to its planar spiral form (or close to) at rest. In embodiments employing the spiral spring 80, at least the outermost section 82 of the spiral spring 80 would be retained by the plunger facing surface of the flange 74, and the solid product 24 would be supported on the top of the spiral spring. In use, when movement of the plunger 50 pushes against the solid product 24 supported by the coils of spiral spring, the inner coils or loops of the spiral spring extend in the Z direction. As the spiral spring extends, the spiral spring forms a somewhat conical shape, and the top edges of the coils or loops apply a shearing force against the outer surface of the solid product 24, thereby pulverizing areas of the solid product 24.

In some embodiments, the extension spring can be made of stainless steel or spring steel (e.g., low-alloy manganese, a medium-carbon steel, a high-carbon steel with a very high yield strength, etc.). In some embodiments, the profile of the extension spring is round in cross-section. In other embodiments, the profile of the extension spring is rectangular in cross-section. Of course, other cross-sectional shapes, such as elliptical, etc., may be practiced with embodiments of the present disclosure.

One example of a method for using the pulverizing device 20 for pulverizing, grinding or otherwise breaking up a solid product into, for example, powder form, will now be described with reference to FIGS. 3 and 4. Firstly, a pulverizing device 20 is obtained, containing a solid product housed within the cavity 40, and in some embodiments, inside the loops of a coil spring 72, as shown in FIG. 3. Next, the handle 52 of the plunger 50 is pushed inwardly (e.g., linear displacement) so that the product contacting surface 54 contacts the solid product 24. With continued pushing movement of the plunger 50 from the position of FIG. 3 to the position shown, for example, in FIG. 4, the solid product 24 is forced against the coils or loops of the coil spring 72. As the coil spring 72 extends, the coil spring 72 conforms somewhat to the shape of the solid product 24.

As such, movement of the solid product 24 with respect to the coil spring 72 from the position shown in FIG. 3 to the position of FIG. 4 causes the edges of the coil spring's coils or loops to apply a shearing force against the outer surface of the solid product 24, thereby pulverizing the brittle surface of the solid product 24 and creating a pulverized formulation (e.g., in powder form). With the aid of gravity, the powder falls through the second opening 30, and is dispensed into the user's hand, a container or other surface, etc., for subsequent use (e.g., consumption, mixing, etc.)

In some embodiments, the pulverizing device 20 may include a somewhat doomed shaped structure 84 associated with the second opening 30. In some embodiments, the structure 84 may act like a dispenser to aid in dispensing the powder from the second opening 30. In that regard, as the powder falls onto the domed surface 86 of the structure 84, the powder tends to slide to the perimeter thereof and falls through a gap 88 formed between the inner perimeter surface of the housing 22 and the perimeter edge of the structure 84. In some embodiments, the structure 84 may also act as a stop for limiting the extension travel of the extension spring 72. To aid in collecting the dispensed powder, a cup or like container (not shown) can be removably attached (e.g., snug fit, press fit, threaded, etc.), to the second end 32 of the housing 22.

In some embodiments, the pulverizing device 20 is manufactured and assembled for single use. In these embodiments, the type of solid product, such as a cosmetic foundation, a cake mascara, etc., is placed in the cavity at the time of assembly. In other embodiments, the pulverizing device 20 is configured to be reusable once the solid product 24 is partially or fully exhausted. For example, to remove and/or replace a partially exhausted solid product 24, the housing may be formed with two housing halves or two parts that can be removeably attached to one another via threaded connection, a snap fit connection, etc. To exchange solid products 24, one part of the housing 22 is detached to expose the cavity 40. The solid product in the cavity 40 is then exchange with a different solid product and the housing part is reattached. Substantially similar steps would be undertaken to refill the pulverizing device 20 after exhaustion of the solid product.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result. Moreover, some of the method steps can be carried serially or in parallel, or in any order unless specifically expressed or understood in the context of other method steps.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "front," "back," "top," "bottom," "upward," "downward," "right hand," "left hand," "lateral," "medial," "in," "out," "extended," "advanced," "retracted," "proximal," "distal," "central," etc. These references, and other similar references in the present application, are only to assist in helping describe and understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also, in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value.

Throughout this specification, terms of art may be used. These terms are to take on their ordinary meaning in the art from which they come, unless specifically defined herein or the context of their use would clearly suggest otherwise.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. An apparatus comprising:

a housing having a cavity and a dispensing outlet;

a plunger movably supported by the housing, a first end of the plunger being positioned exteriorly of the housing and a second end of the plunger being positioned inside the cavity;

an extension spring disposed in the housing, the extension spring arranged and configured to receive or support a friable material adjacent the second end of the plunger, wherein continuous movement of the plunger against the friable material causes relative movement between the friable material and the extension spring, wherein during such relative movement the extension spring applies a shearing force to the friable material for pulverizing the friable material into powder to be dispensed from the dispensing outlet.

2. The apparatus of claim 1, wherein the extension spring is a coil spring.

3. The apparatus of claim 2, wherein the coil spring is a flat coil spring.

4. The apparatus of claim 2, wherein the coil spring has a conical shape, the coil spring being inverted so as to have a first end with a first diameter adjacent the plunger, the coil spring configured to receive the friable material from the first end.

5. The apparatus of claim 1, wherein the plunger movably supported by the housing for linear movement of the plunger.

6. A pulverizing apparatus, comprising:

a housing having a cavity and a dispensing outlet;

a cosmetic product disposed in the housing;

a plunger movably supported by the housing between a first, non-pulverizing position and a second, pulverizing position, a first end of the plunger being positioned exteriorly of the housing and a second end of the plunger being positioned inside the cavity and adjacent the cosmetic product;

a coil spring disposed in the housing, the coil spring arranged and configured to support the cosmetic product adjacent the second end of the plunger, wherein movement of the plunger from the first position to the second position causes the coil spring to apply a shearing force against the cosmetic product to pulverize the cosmetic product into powder to be dispensed from the dispensing outlet.

7. The pulverizing apparatus of claim 6, wherein the coil spring is a flat coil spring.

8. The pulverizing apparatus of claim 6, wherein the coil spring has a conical shape, the conical coil spring arranged in the cavity of the housing such that the smaller end of the conical coil spring is facing the outlet.

9. The pulverizing apparatus of claim 6, wherein the cosmetic product moves linearly with respect to the coil spring via movement of the plunger.

10. The pulverizing apparatus of claim 6, wherein the housing includes a linear bearing surface for movably supporting the plunger and guiding the plunger as the plunger moves linearly from the first position to the second position.

11. The pulverizing apparatus of claim 6, wherein the coil spring tapers from a first end having a first diameter to a second end having a second, smaller diameter, wherein the first end of the coil spring is positioned adjacent the second end of the plunger and is sized to receive the cosmetic product therein.

* * * * *